US005781941A

United States Patent [19]

Radke et al.

[11] Patent Number: 5,781,941

[45] Date of Patent: Jul. 21, 1998

[54] SAFETY BATH MAT

[75] Inventors: Michael D. Radke, Littleton, Colo.; Jeffrey M. Fields, Madison, Wis.

[73] Assignee: Lois F. Fields, South Wayne, Wis.

[21] Appl. No.: 766,050

[22] Filed: Dec. 16, 1996

[51] Int. Cl.[6] ..... A47K 3/02

[52] U.S. Cl. ..... 4/583; 428/327

[58] Field of Search ..... 4/581–583; 428/327

[56] References Cited

U.S. PATENT DOCUMENTS

| | | | |
|---|---|---|---|
| 4,625,344 | 12/1986 | Howard | 4/583 X |
| 4,931,330 | 6/1990 | Stier et al. | 4/583 X |
| 5,375,271 | 12/1994 | Frankel | 4/583 X |

FOREIGN PATENT DOCUMENTS

| | | | |
|---|---|---|---|
| 2108838 | 5/1983 | United Kingdom | 4/581 |
| 2270270 | 3/1994 | United Kingdom | 4/582 |

*Primary Examiner*—Charles E. Phillips
*Attorney, Agent, or Firm*—Vincent & Cooksey

[57] ABSTRACT

A safety bath mat has a layered body with a base layer provided with a coating of adhesive for attaching the mat to the floor of a tub or shower. The body of the mat further includes a second layer in which polycarbonate particles are embedded in vinyl. Additional vinyl covers the first two layers to a substantially uniform thickness while conforming to the underlying rough surface configuration caused by the polycarbonate particles. The upper two layers are transparent, allowing artwork on the upper surface of the base layer to be seen through the two upper layers. An optional thermometer indicates the ambient water temperature, to aid in prevention of stalling. The adhesive has a protective sheet that is removed for installation. The mat is permanently bonded to the tub and provides a durable, slip resistant surface.

6 Claims, 1 Drawing Sheet

SAFETY BATH MAT

TECHNICAL FIELD

This invention relates to safety bath mats for use on the floor of a bath tub or shower to prevent slippage of a person standing on the mat, and more particularly, to such a bath mat having a built-in thermometer for protection against scalding from excessive water temperatures.

BACKGROUND ART

The risk of scalding as a result of excessively high water temperatures in bath tubs is well known. This is particularly a risk with small children who are too young to bathe themselves or to control the temperature of their own baths. It can also be a risk to the elderly and the infirm. One solution to this problem would be a bath mat which would indicate when dangerous water temperatures were present. Ideally, such a mat would also be decorative and brightly colored, in order to be more attractive to small children.

The risks of injury from slipping or falling in bath tubs, or on other similar wet slippery surfaces are also well known. Bath tubs and showers generally have a smooth floor surface rounded at the sides. When such a surface is wet, it is relatively slippery so that a user, when standing thereon or attempting to arise from a sitting position in the bath, has to be constantly on guard against slipping and falling.

In the prior art, two general approaches are used to prevent slipping and falling, namely, removable mats and permanently installed appliques. A removable mat is disadvantageous for several reasons. First, its use is optional and people can and do bathe without using the mat. In a commercial environment, this increases the owner's risk of potential liability. Second, a removable mat can be stolen. Third, a removable mat is messy, particularly upon removal from the tub while still wet. Water clings to the mat and drips on the floor and other nearby areas. Fourth, such a mat is commonly provided with holes that provide areas which are difficult to clean and which allow germs to breed. Fifth, sometimes water gets under the mat, allowing it to shift or slip and thereby defeat the very purpose for which it is designed. Patented examples of such mats are disclosed in U.S. Pat. Nos. 3,418,668 to Anderson et al; 3,341,866 to Wright; and 2,822,553 to Florentine.

A commonly used form of permanently installed applique employs a series of strips which are adhesively bonded to the floor surface of a tub at spaced intervals. Under heavy usage, the strips wear out relatively rapidly, the edges curl, and the strips often have to be replaced two or more times per year. Quite often, the replacing strips have to be set or cured for a period of from several hours to a full day, before the tub can be used. Patented examples of permanently installed slip resistant devices are described in U.S. Pat. Nos. 3,124,811 to Treacy, and 3,836,420 to Friese. Treacy discloses using a plurality of hexagonally shaped ceramic disks or elements adhesively bonded to or embedded in the floor surface. Friese discloses using one or more vinyl appliques having a water resistant adhesive backing. The appliques are ornamentally shaped and have a series of through holes providing a series of edges adapted to grip the feet of a user and prevent slipping. Particulate matter may be impregnated in the applique so as to extend above the upper surface and increase the slip resistance.

U.S. Pat. No. 4,625,344 to Howard discloses a slip-resistant bath mat which provides protection against slippage in a bath tub or the like. However, the Howard mat provides no means for warning of dangerously high water temperatures. Additionally, because the Howard mat uses sand particles embedded in vinyl, it is at best translucent, depending on the amount of sand used. Therefore, if enough sand is used to create optimal roughness and gripping capability, any lettering or decoration of the mat must be made on the upper surface of the mat to prevent the sand particles from obscuring the visibility of such lettering or decoration. This results in any such lettering or decoration being subject to a great deal of wear and tear, both from being stepped and sat upon, as well as from constant exposure to water. This greatly increases the likelihood of the lettering or decoration being worn away over time. On the other hand, less sand may be used in the Howard mat in order to allow lettering or decoration to be placed beneath the upper surface of the mat while still remaining visible, thereby solving the wear and tear problems associated with placing the lettering or decoration on the upper surface of the mat. However, if less than the optimal amount of sand for roughness and gripping purposes is used, the effectiveness of the mat for preventing slipping may be compromised.

DISCLOSURE OF THE INVENTION

In view of the foregoing, one of the objects of the invention is to provide a built-in thermometer to warn of excessively high temperatures, especially for the protection of children.

Another object of the invention is to provide a highly decorative bath mat which will be attractive to young children, and whose decoration will not be easily worn away under normal operating conditions.

Another object is to provide a durable bath mat adapted to be permanently installed in a bath tub or the like to provide a highly slip resistant surface under wet conditions.

Still another object is to provide a bath mat which is easy to install and which is immediately available for use upon installation.

Briefly, the invention comprises a flat, flexible mat having a base formed from virgin vinyl. The base has a lower surface coated with a water resistant adhesive covered by a protective sheet which is removable for installation. The upper portion of the base is covered by a second layer containing clear aggregate particles uniformly coated with vinyl. Preferably, the aggregate particles will be of polycarbonate material, although other clear, rough materials could also be used. At least one upper layer containing a relatively uniform layer of vinyl is overlaid over the second layer. The top surface of the upper layer provides a high degree of resistance to slippage to a user standing thereon with wet feet.

Decorations and/or lettering may be placed on the upper surface of the base, and will be visible through the two transparent layers placed thereon. Alternatively, the polycarbonate particles themselves may be colored and used to form decorations or lettering.

Finally, a substantially flat crystal thermometer may be placed upon the base of the mat prior to adding additional layers thereto, and will be clearly visible when the mat has been installed. This thermometer will give an accurate water temperature reading, to aid in the avoidance of scalding-type injuries. The thermometer will be protected from wear and tear by the additional clear layers which cover it.

In view of the foregoing, several advantages of the present invention are readily apparent. A safety bath mat is provided which is durable and easily installed, and protects against slipping on wet surfaces. The mat may be highly decorative and colorful to be attractive to young children. The mat also includes an optional thermometer, which will aid in warning against excessively high water temperatures. Both the thermometer and any coloring or decoration may be placed on the upper surface of the base of the mat and covered by additional layers of aggregate and vinyl, thereby greatly reducing wear and tear which would occur if they were placed on the upper surface of the mat itself.

Additional advantages of this invention will become apparent from the description which follows, taken in conjunction with the accompanying drawings.

BEST MODE FOR CARRYING OUT THE INVENTION

Figure 1:
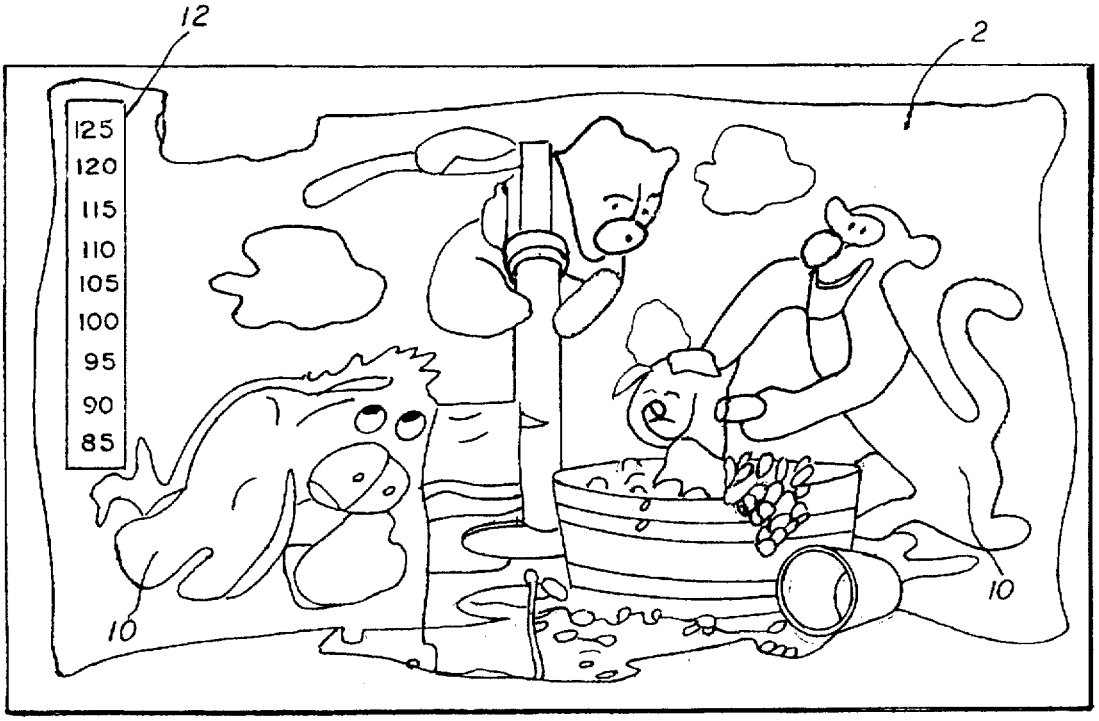
FIG. 1 is a top plan view of a mat embodying the present invention.

Referring now to the drawings, FIG. 1 shows a bath mat 2 permanently attachable to a floor surface on which the user is likely to stand while entering or leaving a tub or shower. Mat 2 is rectangular in plan view and has optional rounded corners to preclude corner lift, i.e., the placing of undue stress and wear on sharp corners which would otherwise cause the sharp corners to wear and turn up or prematurely fail before the rest of the mat.

Figure 2:
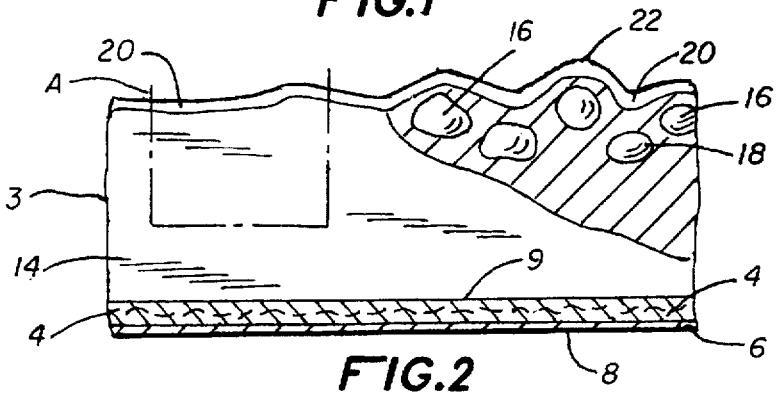
FIG. 2 is an enlarged side elevational view, partly in section, of a mat embodying the invention.
Figure 3:
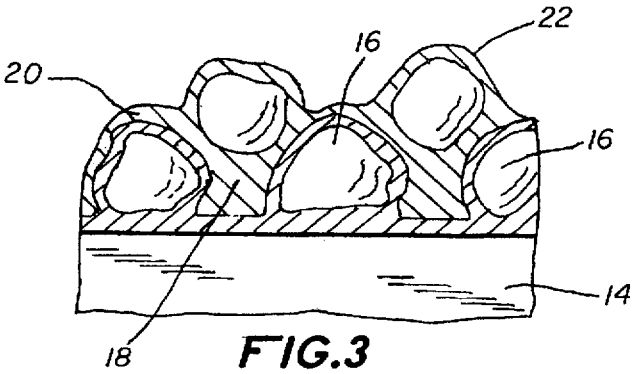
FIG. 3 is a schematic illustration of the area enclosed in reference Box A of FIG. 2, useful in understanding the invention.

As shown in FIG. 2 mat 2 comprises a layered body 3, having a base 4 the lower surface of which is coated with an adhesive layer 6. The lower surface of the adhesive layer 6 is covered with a protective sheet 8. Such sheet removably adheres to the adhesive layer but is non-sticky so that the mat can be readily handled before installation.

The structure of the mat 2 may be best understood by an explanation of the steps in manufacture of the mat. The base 4 is formed from a vinyl sheet having a thickness from 5 to 80 mils, dependent on the desired application. The sheet is first laminated or coated with adhesive layer 6 and then backed with protective sheet 8. The resultant sheet is then die cut to the desired shape of the finished mat to form the base 4 to which the slip resistant materials are to be applied. At this point, coloring or artwork 10 may be applied to the top surface 9 of the base 4. Additionally, a thermometer 12 may also be applied to the top surface 9 of the base 4, to provide readings of the ambient water temperature. For best results, the thermometer 12 will be a substantially flat thermometer of the type which obtains temperature readings from crystals which change color as the temperature changes. Such thermometers are readily commercially available in thicknesses approximating that of a dime, including adhesive backings.

Once the base 4 is completely prepared, a coating of vinyl 14 is added on top of the base 4, by pouring the vinyl onto the base while the vinyl is in a liquid state. While the vinyl is still liquid, polycarbonate aggregate particles 16 are sprayed onto the vinyl 14. As the vinyl dries, the polycarbonate particles 8 are absorbed therein, forming a rough second layer 18 of the vinyl-polycarbonate particle mixture. The particles are substantially evenly spaced throughout the vinyl, and account for at least ten percent by weight of the second layer, in order to provide proper gripping capability. Additional quantities of particles may be added for improved gripping, with about 20–25% by weight being optimal for most applications. Finally, once the second layer has dried, a third layer of clear vinyl is sprayed over the first two layers and dried, forming a third layer 20, thereby completing the mat 2.

The polycarbonate particles are selected for particular qualities. First, they must be readily absorbed into the vinyl. Secondly, they are substantially transparent, and remain so when mixed with the vinyl to form a mixture having a polycarbonate weight of greater than or equal to ten percent of the total weight of the mixture. This allows artwork 10, the thermometer 12, and any selected lettering or the like to be clearly visible through the second and third layers 18 and 20, while still achieving acceptable gripping capability. This is a significant advantage over the use of sand particles, which are generally translucent at best when mixed with vinyl, depending upon the amount of sand used. Generally it is found that if enough sand is used to create optimal roughness and gripping capability —about ten percent by weight—any lettering or decoration of the mat must be made on the upper surface of the mat, in order to avoid the sand particles obscuring the visibility of such lettering or decoration. This results in any such lettering or decoration being subject to a great deal of wear and tear, both from being stepped and sat upon, as well as from constant exposure to water. However, if less than the optimal amount of sand for roughness and gripping purposes is used, the effectiveness of the mat for preventing slipping is compromised. Since the polycarbonate-vinyl layer 18 of the present invention is transparent and allows decorations, thermometers, and the like to be visible when placed on the base 4, wear and tear is greatly reduced as compared to the same additions when placed on the upper surface 22 of the mat 2.

All layers of vinyl are applied within an approximate time period to insure blending and fusing thereof. Each layer is dried by heating to drive off the solvents in the vinyl, the period of heating or drying being effective to nearly completely set up the vinyl and yet not long enough to completely set it before the next layer is applied. This allows the vinyl layers to blend together and fuse to produce a body not subject to delayering. The body is flexible and allows the sand particles suspended therein at different levels, to move without being dislodged when a person steps on or off the mat.

This invention has been described in detail with reference to a particular embodiment thereof, but it will be understood that various other modifications can be effected within the spirit and scope of this invention.

We claim:

1. A safety bath mat adapted to be secured to the floor of a bath tub or shower, comprising:

a layered body having a continuous, unbroken upper surface, said body having a vinyl base layer, a second layer on top of said base layer, said second layer comprising polycarbonate particles suspended in vinyl, said particles being relatively uniformly laterally spaced and surrounded by vinyl whereby said second layer has a relatively rough upper configuration, and a third vinyl layer covering said second layer and provided a substantially uniformly thick coating conforming to the configuration of said second layer, said third layer providing a slip resistant surface adapted to support a person standing thereon, said second and third layers being substantially transparent.

2. A safety bath mat as claimed in claim 1, wherein:

the total weight of said particles suspended in said second layer is equal to or greater than ten percent of the total weight of said second layer.

3. A safety bath mat as claimed in claim 1, further comprising:

an adhesive layer covering the bottom of said base, to adhesively secure said mat to said tub or shower.

4. A safety bath mat as claimed in claim 3, further comprising:

a peelable protective sheet covering said adhesive and being adapted to be removed to expose said adhesive layer for installation of said mat.

5. A safety bath mat as claimed in claim 1, further including:

a flexible thermometer attached to said base, for providing temperature readings of bath water coming into contact with said mat.

6. A safety bath mat adapted to be secured to the floor of a bath tub or shower, comprising:

a layered body having a continuous, unbroken upper surface, said body having a vinyl base layer, a second layer on top of said base layer, said second layer comprising polycarbonate particles suspended in vinyl, said particles being relatively uniformly laterally spaced and surrounded by vinyl, the total weight of said particles suspended in said second layer being equal to or greater than ten percent of the total weight of said second layer, whereby said second layer has a relatively rough upper configuration, and a third vinyl layer covering said second layer and provided a substantially uniformly thick coating conforming to the configuration of said second layer, said third layer providing a slip resistant surface adapted to support a person standing thereon, said second and third layers being substantially transparent.

* * * * *